US008361559B2

(12) United States Patent
Chan et al.

(10) Patent No.: US 8,361,559 B2
(45) Date of Patent: Jan. 29, 2013

(54) METHOD FOR MAKING MAGNESIUM-BASED COMPOSITE MATERIAL

(75) Inventors: Kam-Shau Chan, Taipei Hsien (TW); Cheng-Shi Chen, Taipei Hsien (TW); Kuo-Jung Chung, Taipei Hsien (TW); Qing-Chun Du, Tai-Yuan (CN); Wen-Zhen Li, Beijing (CN)

(73) Assignees: Tsinghua University, Beijing (CN); Hon Hai Precision Industry Co., Ltd., New Taipei (TW)

( * ) Notice: Subject to any disclaimer, the term of this patent is extended or adjusted under 35 U.S.C. 154(b) by 748 days.

(21) Appl. No.: 12/498,732

(22) Filed: Jul. 7, 2009

(65) Prior Publication Data

US 2010/0075064 A1 Mar. 25, 2010

(30) Foreign Application Priority Data

Sep. 19, 2008 (CN) ..... 2008 1 0216307

(51) Int. Cl.
*D05D 1/02* (2006.01)
*B22D 19/14* (2006.01)

(52) U.S. Cl. ..... 427/422; 164/97

(58) Field of Classification Search ..... 164/19, 164/97, 71.1, 113; 427/565, 421.1, 422, 427/427.1
See application file for complete search history.

(56) References Cited

U.S. PATENT DOCUMENTS 4,973,522 A 11/1990 Jordan et al.

FOREIGN PATENT DOCUMENTS

CN 1030259 A 1/1989
CN 1069292 A 2/1993

OTHER PUBLICATIONS

David R. Lide, CRC Handbook of Chemistry and Physics. 2006, 87th Edition, p. 4-73.*
Jie Lan, Yong Yang, Xiaochun Li, Microstructure and microhardness of SiC nanoparticles reinforced magnesium composites fabricated by ultrasonic method, Materials Science & Engineering, 386 (2004), p. 284-290.

* cited by examiner

*Primary Examiner* — Dah-Wei Yuan
*Assistant Examiner* — Nga Leung V Law
(74) *Attorney, Agent, or Firm* — Altis Law Group, Inc.

(57) ABSTRACT

A method for making a magnesium-based composite material includes mixing nanoscale reinforcements with a melted magnesium-based material to obtain a pre-mixture. The pre-mixture is agitated by an ultrasonic process to obtain a mixture. The mixture is sprayed to a substrate.

16 Claims, 4 Drawing Sheets

METHOD FOR MAKING MAGNESIUM-BASED COMPOSITE MATERIAL

BACKGROUND

1. Technical Field

The present disclosure relates to methods for fabricating composite materials and, particularly to a method for fabricating a magnesium-based composite material.

2. Description of Related Art

Nowadays, various alloys have been developed for special applications. Among these alloys, magnesium-based alloys have relatively superior mechanical properties, such as low density, good wear resistance, and high elastic modulus. Generally, two kinds of magnesium-based alloys have been developed: casting magnesium-based alloy and wrought magnesium-based alloy. However, the toughness and the strength of the magnesium-based alloys are not able to meet the increasing needs of the automotive and aerospace industries for tougher and stronger alloys.

To address the above-described problems, magnesium-based composite materials have been developed. In magnesium-based composite materials, nanoscale reinforcements (e.g. carbon nanotubes and carbon nanofibers) are mixed with magnesium metal or alloy. The most common methods for making magnesium-based composite materials are through thixomolding and die-casting. However, in die-casting, the magnesium or magnesium-based alloys are easily oxidized. In thixomolding, the nanoscale reinforcements are prone to aggregate. As such, the nanoscale reinforcements cannot be well dispersed.

What is needed, therefore, is to provide a method of fabrication for a magnesium-based carbon nanotube composite material, in which the above problems are eliminated or at least alleviated.

BRIEF DESCRIPTION OF THE DRAWINGS

Many aspects of the method for fabricating magnesium-based composite material can be better understood with reference to the following drawings. The components in the drawings are not necessarily drawn to scale, the emphasis instead being placed upon clearly illustrating the principles of the present liquid crystal display.

Figure 1:
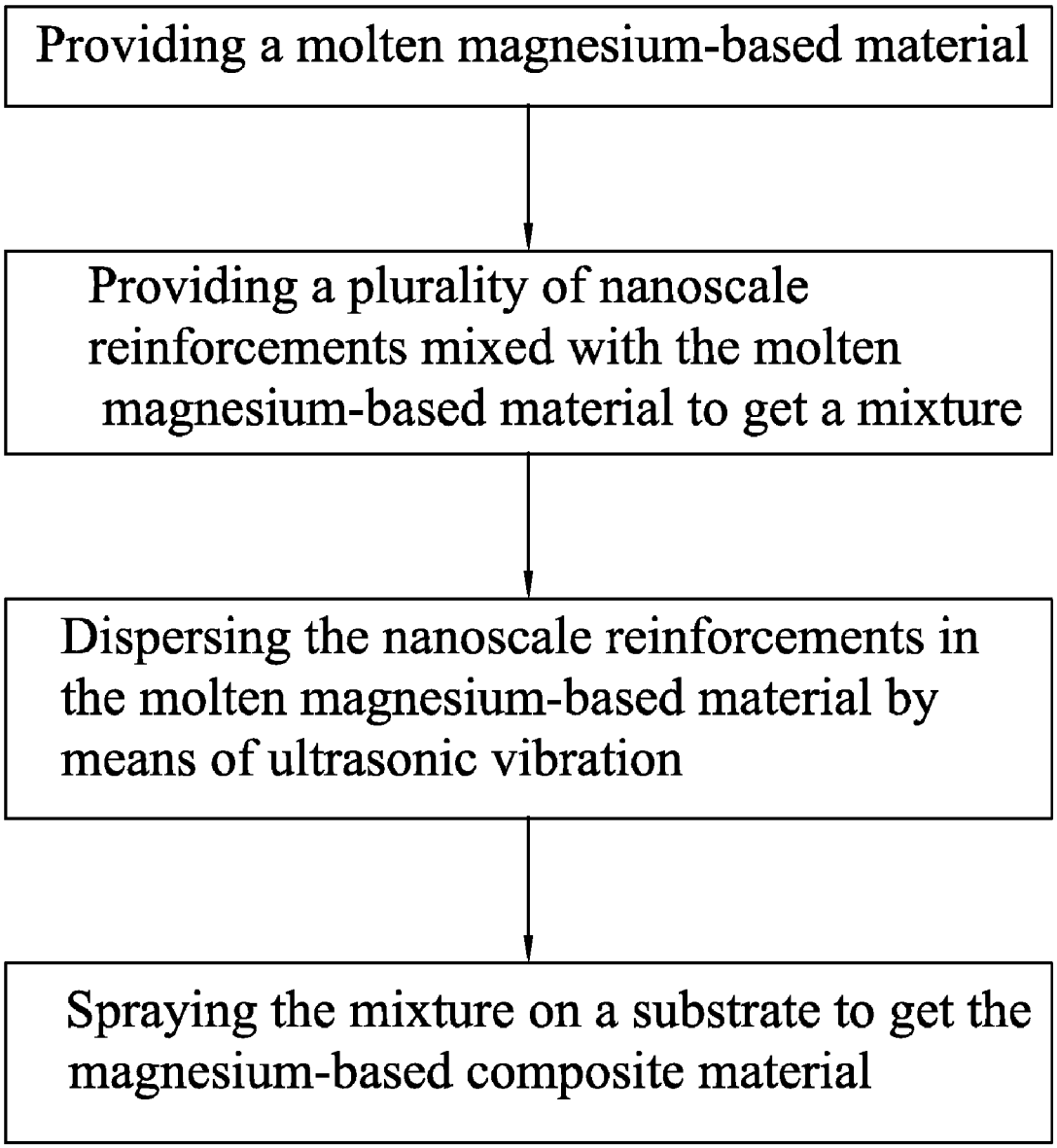
FIG. 1 is a flow chart of a method for fabricating a magnesium-based composite material, in accordance with an embodiment of the present disclosure.

Corresponding reference characters indicate corresponding parts throughout the several views. The exemplifications set out herein illustrate at least one embodiment of the present magnesium-based composite material, in at least one form, and such exemplifications are not to be construed as limiting the scope of the disclosure in any manner.

DETAILED DESCRIPTION

References will now be made to the drawings to describe, in detail, various embodiments of the method for fabricating magnesium-based composite material.

Referring to FIG. 1, a method for fabricating a magnesium-based composite material includes the steps of: (a) providing a molten magnesium-based material; (b) adding a plurality of nanoscale reinforcements with the molten magnesium-based material to get a pre-mixture; (c) dispersing the nanoscale reinforcements in the molten magnesium-based material by means of ultrasonic vibration to get a mixture; and (d) spraying the mixture on a substrate to get the magnesium-based composite material.

In step (a), the molten magnesium-based material is manufactured by the following steps:

(a1) providing a magnesium-based material; and (a2) heating the magnesium-based material in an environment with a protective gas.

In step (a1), the magnesium-based material can be pure magnesium or magnesium-based alloys. The components of the magnesium-based alloys include magnesium and other elements selected from zinc (Zn), manganese (Mn), aluminum (Al), thorium (Th), lithium (Li), silver, calcium (Ca), and any combinations thereof. A weight ratio of the magnesium to the other elements can be more than about 4:1.

In step (a2), the magnesium-based material is heated at a temperature of about 630 to about 670° C. with the protective gas therein, to form the molten magnesium-based material. The protective gas can form a thin protective film on the surface of the melted magnesium-based material to isolate the melted magnesium-based material from the atmosphere and prevent oxidation and burning of the molten magnesium-based material. The protective gas can be selected from the group consisting of nitrogen ($N_2$), an $N_2$ and sulfur hexafluoride ($SF_6$) gas mix, and a sulfur dioxide and dry air gas mix. In one embodiment, the material of the magnesium-based material is pure magnesium, the protective gas is $N_2$, and the temperature is about 650° C.

In step (b), a plurality of nanoscale reinforcements are mixed with the molten magnesium-based material to obtain a pre-mixture. The material of the nanoscale reinforcements can be selected from a group consisting of carbon nanotubes, silicon carbide (SiC), alumina ($Al_2O_3$), titanium carbide (TiC), and combinations thereof. The shape of the nanoscale reinforcements can be selected from a group consisting of nanowire, nanotube, nanorod, nanosphere and combinations thereof. A diameter of the nanoscale reinforcements can be in the approximate range from about 1 to about 100 nanometers. In one embodiment, the nanoscale reinforcements are carbon nanotubes with diameters of about 20 to about 30 nanometers.

A method of mixing the nanoscale reinforcements with the molten magnesium-based material includes the following steps of:

(b1) adding the nanoscale reinforcements in the molten magnesium-based material with a protective gas; and (b2) mechanically agitating the molten magnesium-based material.

During the process of mixing the nanoscale reinforcements with the molten magnesium-based material, the molten magnesium-based material should be maintained in the molten state. The temperature of the magnesium-based material in the molten state is relative to the components of the magnesium-based material. In one embodiment, the temperature should be maintained at about 670 to about 680° C. to lower the viscosity of the magnesium-based material and prevent the nanoscale reinforcements from agglomerating. In this temperature range, the thin protective film of the protective gas should not be damaged or destroyed.

In step (b1), the carrier gas blows the nanoscale reinforcements into the molten magnesium-based material. The carrier gas can be selected from a group consisting of $N_2$, argon (Ar), an $N_2$ and Ar gas mixture, and an $N_2$ and carbon dioxide ($CO_2$) gas mixture. A weight percentage of the nanoscale reinforcements in the molten magnesium-based material can be approximately about 0.01% to about 10%. An agitator is used to mechanically agitate the nanoscale reinforcements once in the molten magnesium-based material. The rotational speed of the agitation process can be about 20 to about 60 rev/minute. When the molten magnesium-based material has a low viscosity the nanoscale reinforcements are less likely to agglomerate. The rotational direction of the agitation process can be done in a clockwise or counter-clockwise manner, or by alternating between the two. In one embodiment, the carrier gas is Ar, the weight percentage of the nanoscale reinforcements in the mixture is 5%, and the rotational direction of the agitation process is clockwise. Injecting the nanoscale reinforcements into the molten magnesium-based material with a gas can produce a gradual dispersion of the nanoscale reinforcements in the molten magnesium-based material, and prevent the nanoscale reinforcements from agglomerating and floating.

In step (c), the nanoscale reinforcements are further dispersed in the molten magnesium-based material using ultrasonic vibration. The pre-mixture can be ultrasonically vibrated for about 1 to about 10 minutes in a protective gas environment. The protective gas can be selected from the group consisting of $N_2$, an $N_2$ and $SF_6$ gas mixture, and a sulfur dioxide ($SO_2$) and dry air gas mixture. In one embodiment, the protective gas is $N_2$. The temperature of the magnesium-base material in the molten state is relative to the components of the magnesium-based material. In one embodiment, the temperature should be maintained at about 670 to about 680° C. to lower the viscosity of the magnesium-based material and prevent the nanoscale reinforcements from agglomerating and the molten magnesium-based material burning. The operation mode of ultrasonic vibration can be intermittent or continuous. In one embodiment, the operation mode of the ultrasonic vibration is intermittent. The frequency of the ultrasonic vibrations can be in the approximate range from about 15 to about 20 kHz. Vibration time can be about 1 to about 10 minutes depending on the amount of the molten magnesium-based material. In one embodiment, two ultrasonic frequencies, 15 kHz and 20 kHz, are used. The ultrasonic vibration includes the following steps of: using 15 kHz frequency to generally disperse the nanoscale reinforcements in the molten magnesium-based material, then using 20 kHz frequency to violently vibrate the molten magnesium-based material, and obtaining the mixture in which the nanoscale reinforcements uniformly dispersed.

In step (d), an inert gas is used to spray the mixture on the substrate under a predetermined pressure. The pressure is about 0.5 to about 0.9 MPa and the inert gas can be selected from a group consisting of $N_2$, Ar, an $N_2$ and Ar gas mixture, and an $N_2$ and $SF_6$ gas mixture. In one embodiment, the inert gas is $N_2$, and the pressure is about 0.8 Mpa. The process of spraying the mixture includes the following steps of: nebulizing the mixture with the inert gas to droplets; spraying the droplets on the substrate to get the magnesium-based composite material. The temperature is maintained in the range of about 680 to about 730° C. to lower the viscosity of the mixture and prevent oxidation and burning of the mixture. In one embodiment, the temperature is in the range of about 690 to about 710° C., which is higher than the temperature in the ultrasonic process.

The magnesium-based composite material got by the above-described steps. The above-described steps can be repeated many times. The magnesium-based composite material can be melted and annealed.

In the above-described steps, an additional step of pressing the magnesium-based composite material by rollers can be further provided after the step of spraying the mixture on the substrate. The magnesium-based composite material passes through the gap of the rollers, and a pressure is applied on the magnesium-based composite material by the rollers to obtain a predetermined thickness.

Figure 2:
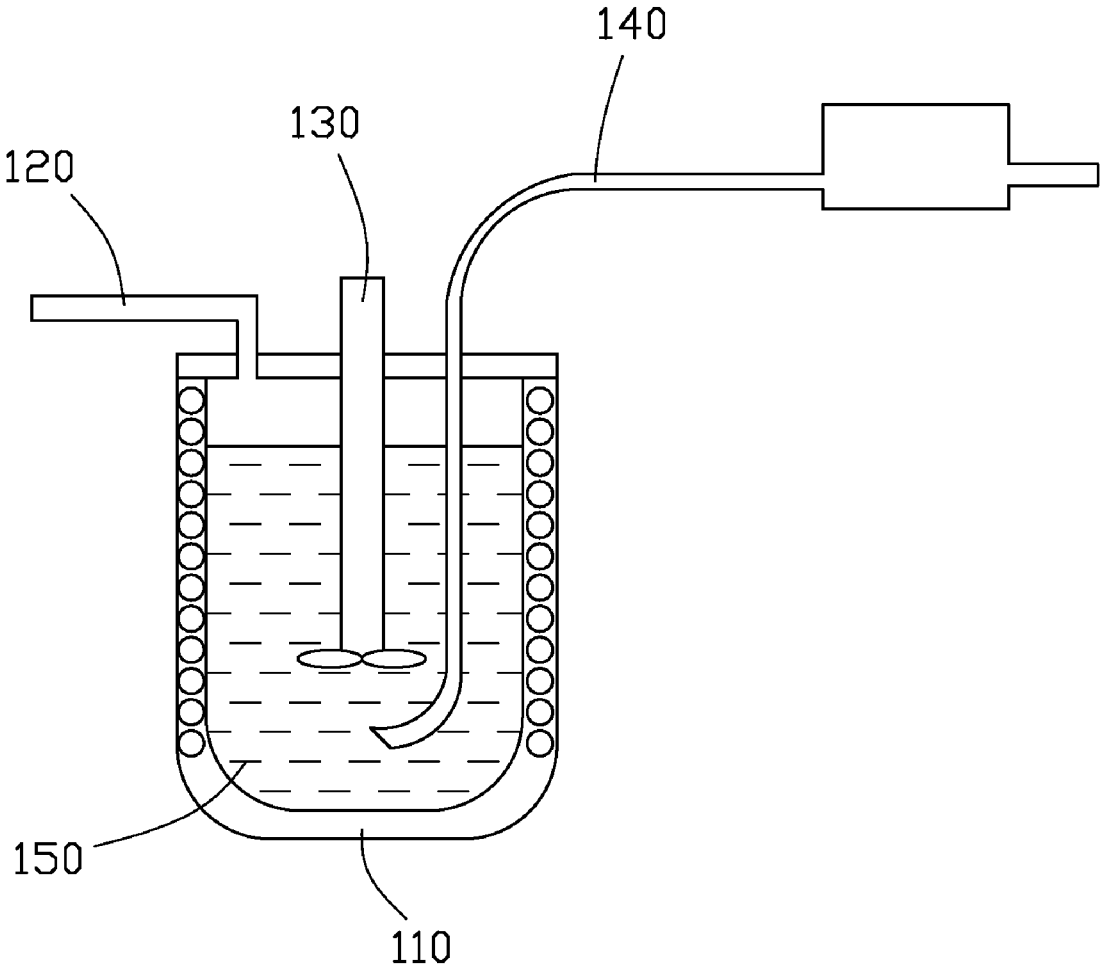
FIG. 2 is a schematic view of an apparatus with an agitator to mix nanoscale reinforcements and melted magnesium-based material of FIG. 1.
Figure 3:
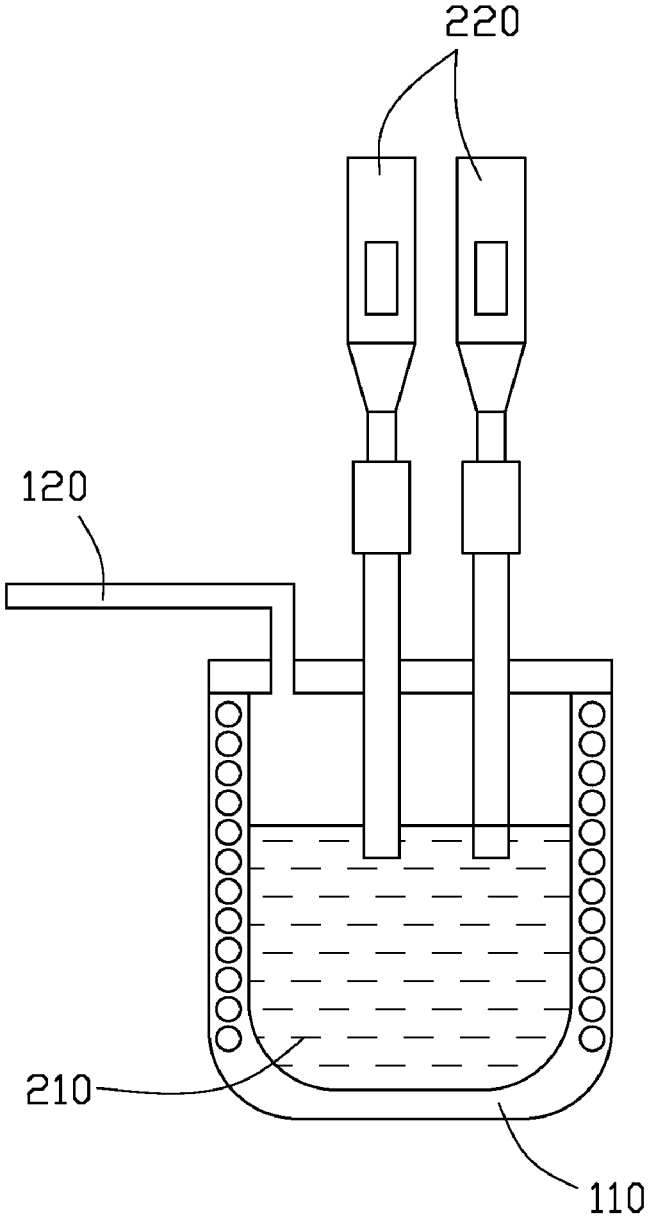
FIG. 3 is a schematic view of an apparatus with an ultrasonic vibrator to dispersing the nanoscale reinforcements in the melted magnesium-based material to get a mixture of FIG. 1.
Figure 4:
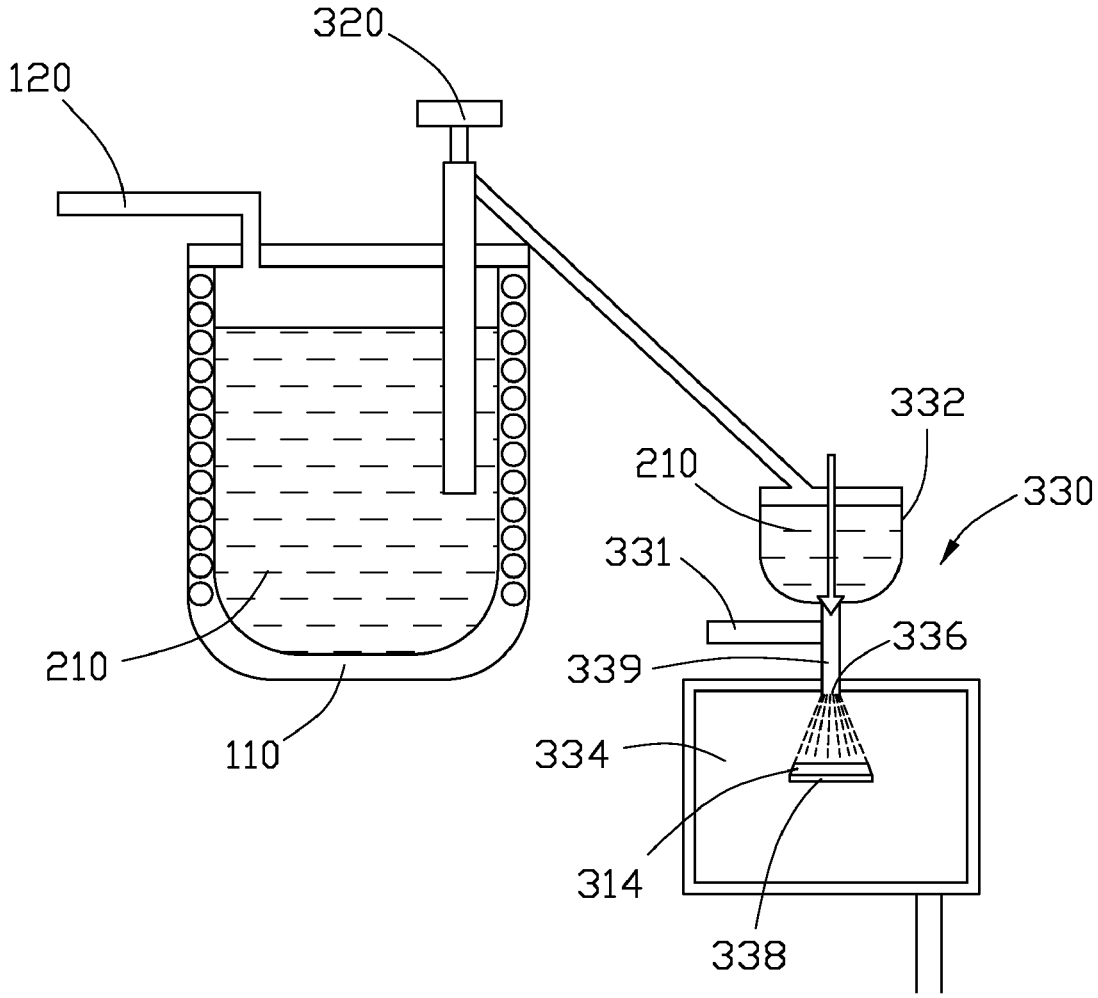
FIG. 4 is a schematic view of an apparatus for spray-forming the mixture to get a magnesium-based composite material of FIG. 1.

Referring to FIG. 2 to FIG. 4, a method for fabricating the magnesium-based composite material using an apparatus is provided.

In step (a), the magnesium-based material is melted in a closed oven 110 with the protective gas therein. The protective gas is introduced via an inlet pipe 120 into the oven 110 and the magnesium-based material is heated at a temperature of about 630 to about 670° C. with the protective gas therein, to form the molten magnesium-based material 150. In one embodiment, the material of the magnesium-based material is pure magnesium, the protective gas is $N_2$, and the temperature is about 650° C. The molten magnesium-based material 150 is obtained in the oven 110 at a temperature of about 650° C. The flow rate of the protective gas in the inlet pipe 120 is in a range of about 1 to about 20 milliliter (ml)/min.

In step (b), a plurality of nanoscale reinforcements is added into the oven 110 by a carrier gas via feeding pipe 140 in the protective gas condition. An agitator 130 is used to mechanically agitate the nanoscale reinforcements and the molten magnesium-based material 150 to obtain a pre-mixture 210 (as shown in FIG. 3) at the temperature of about 670 to about 680° C. The rotation speed of the agitation process is about 20-60 rev/minute. The molten magnesium-based material 150 has low viscosity to prevent the nanoscale reinforcements from agglomerating. After adding the nanoscale reinforcements into the magnesium-based material 150, the feeding pipe 140 and the agitator 130 are removed from the oven 110.

In step (c), an ultrasonic vibrator 220 is provided to disperse the nanoscale reinforcements in the molten magnesium-based material 150. The protective gas is insufflated via the inlet pipe 120 into the oven 110 which temperature is about 670 to about 680° C. At least one ultrasonic vibrator 220 is inserted into the pre-mixture 210 to vibrate the pre-mixture 210 for about 1 to about 10 minutes.

In step (d), a spraying device 330 is used to spray the pre-mixture 210 on a collecting substrate 338 to obtain a magnesium-based composite material 314 on the collecting substrate 338. The collecting substrate 338 can be fixed or removable. The spraying device 330 includes a hopper 332, an inlet line 331, an atomizing chamber 334, a connecting line 339, and a spray nozzle 336. The inlet line 331 connects to the connecting line 339. The collecting substrate 338 is opposite to the spray nozzle 336, which is in the atomizing chamber 334. The distance between the spray nozzle 336 and the collecting substrate 338 can be about 200 to about 700 millimeter. An inert gas enters the connecting line 339 via the inlet line 331. The inert gas can be selected from a group consisting of $N_2$, Ar, an $N_2$ and Ar gas mixture, and an $N_2$ and $SF_6$ gas mixture. The mixture 210 is atomized to droplets and sprayed on the collecting substrate 338 to get the magnesium-based composite material 314. The spraying process of the mixture 210 includes the following steps of:

(4a) pumping the mixture 210 into the hopper 332 via a pump 320 at the temperature in the range of about 680 to about 730° C.;

(4b) nebulizing the mixture 210 to droplets by the inert gas in the connecting line 339 in the pressure of about 0.5 to about 0.9 MPa; and (4c) spraying the droplets on the collecting substrate 338 through the spray nozzle 336. In one embodiment, the inert gas is $N_2$, the temperature is in the range of about 690 to about 710° C., the pressure is about 0.8 Mpa, and the distance between the spray nozzle 336 and the collecting substrate 338 is 300 millimeter.

In the above-described steps, an additional step of pressing the magnesium-based composite material by rollers can be further provided after the step of spraying the mixture on the substrate. The predetermined thickness of the magnesium-based composite material can depend on the gap of the rollers and amount of the spray.

The method for fabricating a magnesium-based composite material in the present embodiment has the many advantages including the following. Firstly, the method of using gas carrying manner to carry the nanoscale reinforcements into the molten magnesium-based material is able to gradually disperse the nanoscale reinforcements in the molten magnesium-based material and also to prevent the nanoscale reinforcements from agglomerating and floating. Further, the ultrasonic vibrator can cause a violent movement of the mixture to uniformly disperse the nanoscale reinforcements in the molten magnesium-based material. Additionally, the mixture is atomized to droplets and sprayed to the collecting substrate. During the method, the uniform dispersion of the nanoscale reinforcements in the magnesium-based composite material is achieved. The resulting magnesium-based composite material is strong, tough, and can be widely used in a variety of fields, such as the automotive and aerospace industries.

Finally, it is to be understood that the above-described embodiments are intended to illustrate rather than limit the disclosure. Variations may be made to the embodiments without departing from the spirit of the disclosure as claimed. The above-described embodiments illustrate the scope of the disclosure but do not restrict the scope of the disclosure.

What is claimed is:

1. A method for fabricating a magnesium-based composite material, the method comprising the steps of:

(a) providing a molten magnesium-based material and a plurality of nanoscale reinforcements, maintaining the molten magnesium-based material at a temperature of about 630° C. to about 670° C. in an atmosphere of protective gas;

(b) obtaining a pre-mixture by mixing the molten magnesium-based material and the nanoscale reinforcements at a temperature of about 670° C. to about 680° C.;

(c) obtaining a mixture by ultrasonically dispersing the nanoscale reinforcements in the pre-mixture at a temperature of about 670° C. to about 680° C.; and (d) spraying the mixture on a substrate.

2. The method as claimed in claim 1, wherein the molten magnesium-based material is pure magnesium or magnesium-based alloys.

3. The method as claimed in claim 1, wherein the nanoscale reinforcements comprise of a material selected from a group consisting of nanoscale carbon, silicon carbide (SiC), alumina ($Al_2O_3$), titanium carbide (TiC), and combinations thereof.

4. The method as claimed in claim 1, wherein the diameter of the nanoscale reinforcements is in the range from about 1 to about 100 nanometers, a weight percentage of the nanoscale reinforcements in the mixture is in the range of about 0.01% to about 10%.

5. The method as claimed in claim 1, wherein the step of obtaining the pre-mixture comprises the steps of:

supplying a carrier gas to carry the nanoscale reinforcements into the molten magnesium-based material; and mechanically agitating the molten magnesium-based material by an agitator.

6. The method as claimed in claim 5, wherein the carrier gas comprises of a material selected from a group consisting of $N_2$, argon (Ar), an $N_2$ and Ar gas mixture, and an $N_2$ and carbon dioxide ($CO_2$) gas mixture.

7. The method as claimed in claim 1, wherein the step of obtaining the mixture comprises employing an ultrasonic vibrator to vibrate the mixture for about 1 to about 10 minutes.

8. The method as claimed in claim 1, wherein the step of spraying the mixture on the substrate comprises applying an inert gas to spray the mixture on the substrate.

9. The method as claimed in claim 8, wherein the inert gas is selected from a group consisting of nitrogen ($N_2$), argon (Ar), a mixture gas of $N_2$ and Ar, and a mixture gas of $N_2$ and sulfur hexafluoride ($SF_6$).

10. The method as claimed in claim 1, further comprising pressing the magnesium-based composite material after the step of spraying the mixture on the substrate.

11. The method as claimed in claim 1, wherein the ultrasonically dispersing is conducted at a frequency of about 15 kHz.

12. The method as claimed in claim 1, wherein the ultrasonically dispersing is conducted at a frequency of about 20 kHz.

13. The method as claimed in claim 1, further comprising pressing the magnesium-based composite material by rollers after the step of spraying the mixture on the substrate.

14. A method for fabricating a magnesium-based composite material, the method comprises the steps of:

placing a magnesium-based material in an oven with a protective gas;

obtaining a molten magnesium-based material by heating the magnesium-based material to a temperature of about 630° C. to about 670° C.;

carrying nanoscale reinforcements into the oven by a feeding pipe;

obtaining a pre-mixture at a temperature of about 670° C. to about 680° C. by agitating the nanoscale reinforcements and the molten magnesium-based material by an agitator;

obtaining a mixture at a temperature of about 670° C. to about 680° C. by vibrating the pre-mixture by an ultrasonic vibrator; and spraying the mixture on a collecting substrate by a spray-forming device.

15. The method as claimed in claim 14, wherein the spray-forming device comprises a hopper, an atomizing chamber, a connecting line connecting the hopper and the atomizing chamber, a spray nozzle is on an end of the connecting line inside the atomizing chamber, an inlet line connects to the connecting line, and the collecting substrate is opposite to the spray nozzle.

16. The method as claimed in claim 15, wherein the step of spraying the mixture on the collecting substrate comprises the steps of pumping the mixture into the hopper at the temperature about 680° C. to about 730° C.; supplying an inert gas into the connecting line though the inlet line at a pressure of about 0.5 to about 0.9 MPa; atomizing the mixture to droplets in the connecting line; and spraying the droplets to the collecting substrate through the spray nozzle.

* * * * *